United States Patent [19]

Hoegler et al.

[11] Patent Number: 4,959,585

[45] Date of Patent: Sep. 25, 1990

[54] ELECTRIC INCANDESCENT LAMP AND METHOD OF MANUFACTURE THEREFOR

[75] Inventors: Leonard E. Hoegler, Solon; Gerald A. Johnson, Chagrin Falls; Diana M. Essock, Moreland Hills; Kent K. Kipling, Solon, all of Ohio

[73] Assignee: General Electric Company, Schenectady, N.Y.

[21] Appl. No.: 240,336

[22] Filed: Sep. 6, 1988

[51] Int. Cl.[5] ..... H01J 1/94; H01J 19/48; H01J 9/02

[52] U.S. Cl. ..... 313/271; 313/274; 313/331; 313/569; 313/574; 313/578; 313/623; 313/631; 445/32

[58] Field of Search ..... 313/569, 574, 578, 631, 313/623, 274, 271, 273, 315, 331, 332; 445/32, 27

[56] References Cited

U.S. PATENT DOCUMENTS

| | | | |
|---|---|---|---|
| 3,156,841 | 11/1964 | Ayres | 313/331 |
| 3,355,613 | 11/1967 | Dayton et al. | 313/578 |
| 3,376,460 | 4/1968 | Jameson | 313/274 |
| 3,423,622 | 1/1969 | Rowe | 313/331 |
| 3,497,754 | 2/1970 | Johnson | 313/578 |
| 4,272,698 | 6/1981 | Oyama et al. | 313/274 |
| 4,389,201 | 6/1983 | Hansler et al. | 445/26 |
| 4,588,923 | 5/1986 | Hoegler et al. | 313/579 |
| 4,598,342 | 7/1986 | English et al. | 313/273 |
| 4,652,789 | 3/1987 | Kawakatsu et al. | 313/315 |

FOREIGN PATENT DOCUMENTS

| | | | |
|---|---|---|---|
| 1340778 | 12/1973 | United Kingdom | 313/271 |

*Primary Examiner*—Donald J. Yusko
*Assistant Examiner*—Michael Horabik
*Attorney, Agent, or Firm*—John P. McMahon; Stanley C. Corwin; Fred Jacob

[57] ABSTRACT

An electric incandescent lamp having an improved coiled refractory metal filament construction is disclosed which enables the lamp to provide a more precise light source. Various lamp and coiled filament configurations are disclosed to include employment of a reflective film for improved efficiency of lamp operation while a halogen substance can also be included in the inert gas filling for this purpose. A method to manufacture the disclosed lamp improvement is also provided.

61 Claims, 3 Drawing Sheets

ELECTRIC INCANDESCENT LAMP AND METHOD OF MANUFACTURE THEREFOR

RELATED PATENT APPLICATIONS

A co-pending application Ser. No. 06/944,918 filed Dec. 22, 1986 now abandoned and assigned to the same assignee as the present invention discloses a related electric incandescent lamp construction employing a coiled incandescent lamp filament which has lighted and unlighted sections. Another co-pending application Ser. No. 243,371 filed Oct. 17, 1988 now U.S. Pat. No. 4,918,354 and again assigned to the same assignee as the present invention discloses a different electric incandescent lamp construction wherein the lamp filament further includes lead-in conductors enabling the filament to be more accurately positioned within the lamp envelope. Since the present invention represents an improvement thereof, both referenced co-pending applications are specifically incorporated herein by reference.

BACKGROUND OF THE INVENTION

A wide variety of electric incandescent lamps employ a coiled refractory metal filament as the light source means to provide general illumination. Recent development of increasingly more energy efficient as well as more optically precise light sources require the coiled filament to be accurately centered within the lamp envelope. More particularly, one such energy efficient lamp employs an elongated tubular lamp envelope with the coiled filament being aligned substantially coincident with the longitudinal axis of the lamp envelope and provides a reflective film on the lamp envelope to reflect infrared radiation back to the lamp filament. A representative structural configuration for such type lamp is disclosed in U.S. Pat. No. 4,588,923, assigned to the assignee of the present invention and which is specifically incorporated herein by reference into the present application since the same general lamp configuration can be employed in one embodiment of the present lamp improvement. Still other optical considerations dictate precise centering of the coiled filament within the lamp envelope when such light source is lodged within a related lighting device such as a reflector lamp as recognized in the previously cited commonly assigned Ser. No. 06/944,918 application now abandoned. Manufacturing constraints hinder these efforts since the conventional coiled filaments are produced by winding a single strand of the refractory metal wire on a retractable or dissolvable mandrel. This manufacturing technique restricts the filament geometry and dimensions to relatively simple configurations such as cylindrical or rectangular shapes. Additionally, the central portion of such filaments cannot be larger in diameter than the coil end turn diameter.

Coiled refractory metal filaments having improved physical configurations to provide a more precise light source means in an electric incandescent lamp are thereby still highly desirable. To further illustrate, coiled filaments formed in exterior shape of an ellipse or hyperboloid would enable such light source means to avoid several optical drawbacks now encountered with the conventional cylindrically shaped coil filaments in reflector lamps. Such provision of a point type illumination source in a reflector lamp further enhances focusing of the overall output light beam pattern. Accordingly, such improvement would not only find utilization in reflector lamps suitable for more precise indoor illumination but would prove equally beneficial in other type end-product applications such as vehicle headlamps, flashlights, and the like. It becomes further desirable in such manner to provide a coiled filament having an external contour which more closely adheres to the interior shape of the lamp envelope. Better conformity in this regard can reduce the end losses now experienced in the aforementioned prior art lamps which utilize a reflective film in conjunction with a cylindrical coil lodged in the lamp envelope having a tubular envelope shape. Still other coiled filament shapes prove desirable based upon related optical considerations for an electric incandescent lamp. Adjusting the lighted portion of the coiled filament along its length again enhances centering of the light source within the lamp envelope. Moreover, it becomes further desirable that the length of the lighted portion of the coiled filament be accurately and easily adjusted so as to provide various operating wattage ratings for an incandescent lamp.

It is a principal object of the present invention, therefore, to provide improved light source means for an electric incandescent lamp utilizing a coiled refractory metal filament which has various novel physical configurations.

It is another important object of the present invention to provide improved means whereby such novel coiled refractory metal lamp filaments are centered within the envelope member of an electric incandescent lamp.

A still further important object of the invention is to provide electric incandescent lamp constructions exhibiting improved operating efficiency attributable to novel light source means therein being employed.

Still a further important object of the invention is to provide an improved coiled filament assembly for an electric incandescent lamp enabling still more reliable lamp manufacture, particularly with existing high speed lamp manufacturing equipment.

These and other objects of the present invention will become more apparent upon consideration of the following description for the present invention.

SUMMARY OF THE INVENTION

In general and in accordance with one aspect of the present invention, various novel coiled refractory metal wire filament configurations have now been discovered enabling electric lamps to provide improved illumination. More particularly, the present incandescent filaments comprise a continuous length of refractory metal wire formed directly into an elongated coil having a central axis and with coil turns at both ends of the elongated coil having a different diameter than the diameter of the central coil turns. In one embodiment the diameter of the coil end turns is significantly greater than the diameter of the central coil turns. In a different embodiment the diameter of the coil end turns is significantly less than the diameter of the central coil turns. Both illustrated filament coil configurations are hermetically sealed within the lamp envelope in a manner to be hereinafter more fully described which can include direct hermetic sealing of the coil end turns to the vitreous lamp envelope material as well as first connecting the coil end turns to conventional lead-in conductor elements and hermetically sealing these elements within the lamp internal cavity. Centering of the present lamp coil configurations within the lamp envelope can also proceed in a conventional manner. For example, in one already known incandescent lamp construction having an elongated lamp envelope, the central axis of the present filament coil can be aligned substantially coincident with the longitudinal lamp axis as well as further centered within the lamp envelope cavity along said lamp axis. A typical filament coil of the present invention suitable for such lamp construction comprises a first coil diameter enabling the central axis of the elongated coil to be coaxial with the longitudinal axis of the lamp and with the coil end turns being further joined to coil turns having a smaller diameter which are also aligned along the longitudinal axis of the lamp to provide the principal light output from the elongated coil. Ball, elliptical, cylindrical or hyperboloid shaped filament coils provided in accordance with the present invention can likewise be centered within the internal cavity of the illustrated lamp construction. Since all of the above illustrated present coil configurations can be expected to improve the operating efficiency in known single end lamp constructions as well as double end lamp constructions to some degree, it follows that a relatively broad class of incandescent lamp constructions are also herein contemplated.

The above defined type filament coil configurations are formed dynamically from a continuous length of the refractory metal wire in existing mechanical spring coiling equipment adapted to provide the desired coil length, coil turn diameters, pitch and particular turn convolutions in such material. Thus a desired tungsten or molybdenum primary coil configuration can be produced at ordinary ambient conditions with shaping tools by feeding a spool of the uncoiled wire to this equipment having the conventional wire diameter sizes now being employed for lamp coils in conventional low voltage type incandescent lamps. In a similar manner, a coiled coil lamp filament having the above defined multiple diameter configuration can be produced in the same equipment from a continuous length of the primary coiled wire to serve as a filament coil in high voltage type lamps. The coil length, coil turn diameters, pitch and turn convolutions are again programmed into the existing equipment with computerized control means and with the wire diameter being selected to generally correspond with that now being employed for the conventional lamps of this type. A modified coiled coil configuration can also be formed in this equipment from a continuous length of the primary coiled wire previously formed by winding a single strand of the uncoiled refractory metal wire around a dissolvable mandrel core. Such coiled coil product can thereafter be selectively etched in a manner disclosed in the previously referenced Ser. No. 06/944,918 application now abandoned to provide a final multidiameter filament coil having both lighted and unlighted segments. The existing automated equipment upon which the present coil configurations can be formed in such novel dynamic manner are commericially available such as the MCS Extension Spring Coiling machines, model MCS-15E and others, which are now being marketed by K. P. American Corporation, Southfield, Michigan.

In general and in accordance with a different aspect of the present invention, an improved electric incandescent lamp is provided comprising, in combination, an elongated hermetically sealed light transmissive lamp envelope containing an inert gas filling and light source means hermetically sealed within the lamp envelope. The light source means has as the incandescent filament a continuous length of refractory metal wire formed directly into an elongated coil having a central axis and with the coil turns at both ends of the elongated coil having a different diameter than the diameter of the central coil turns. Centering of the filament coil in such lamp construction is provided with the central axis of the elongated filament coil being aligned along the longitudinal axis of the lamp envelope and with the lighted portion of the filament being further preferably centered with respect to the ends of the lamp envelope. A representative lamp embodiment having such structural configuration comprises, in combination, an elongated hermetically sealed light transmissive lamp envelope containing an inert gas filling and longitudinally extending light source means having a central axis substantially coincident with the longitudinal axis of the lamp envelope which is hermetically sealed to opposite ends of the lamp envelope. The light source means includes as the incandescent filament a continuous length of refractory metal wire in the form of an elongated multiple diameter coil having a central axis with coil end turns disposed at opposite ends of the elongated coil. The elongated coil has a first coil diameter enabling the central axis of the elongated coil to be coaxial with the longitudinal axis of the lamp envelope. The elongated coil further having its coil end turns being further joined to coil turns having a smaller coil diameter which are also aligned along the longitudinal axis of the lamp envelope to provide the principal light output from the elongated filament coil. Such construction of the filament coil in the illustrated lamp embodiment thereby enables the lighted length of the filament coil to be more accurately centered within an elongated lamp envelope with respect to both its longitudinal axis as well in directions transverse thereto.

In a different preferred lamp embodiment of the present invention but which can utilize the same coil construction employed in the immediately preceding lamp embodiment, there is provided a tubular hermetically sealed light transmissive lamp envelope containing an inert gas filling, an incandescent refractory metal coiled filament having a linear axis substantially coincident with the longitudinal axis of the lamp envelope and extending substantially the full length of the lamp envelope. The lead-in conductors are sealed through opposite ends of the lamp envelope and each conductor is joined directly to opposite end turns of the coiled filament. The lead-in conductors each comprising refractory metal wire lengths having the outermost ends aligned along the central axis of the elongated filament coil. The filament coil in this lamp is preferably tungsten while the lead-in conductors are molybdenum although it is contemplated that lead-in conductors of tungsten can also be used. The preferred lamp embodiment further employs a reflective film deposited on the surface of the lamp envelope for improved operating efficiency since the filament coil emits both in the visible and infrared spectral regions. As disclosed in the aforementioned prior art patent, this reflective film is capable of operating in a temperature range up to and including 950° C. with said film being formed of a plurality of layers exhibiting high and low optical refractive indices of refractory materials which are effective to establish a pass-band characteristic and a stop-band characteristic providing these selective radiant energy distribution above specified. The coiled refractory metal filament in said lamp extends the axial length of the lamp envelope while being mechanically and electrically connected at both ends to the lead-in conductors hermetically sealed at the envelope ends. In a preferred method of manufacture for such lamp construction, a pre-assembly of the lamp filament coil and lead-in conductors is first effected and said pre-assembly thereafter inserted into one end of the cylindrical lamp tube. A fill of inert gas which preferably contains a small quantity of a halogen substance to further improve the lamp operating efficiency is added to the lamp envelope all in an otherwise conventional lamp manufacturing manner. Hermetically sealing both ends of the lamp envelope at the lead-in conductor locations completes said lamp manufacture with the filament coil thereafter being maintained at the center of the envelope cylinder and extending along its axial length.

In a still different preferred lamp construction utilizing the presently improved light source means, there is employed an elongated lamp envelope which can have an ovoid contour or bulbous mid-portion and further includes a reflective film deposited on the exterior surface of said lamp envelope to improve lamp operating efficiency. To better establish maximum optical cooperation between said reflective film and the multidiameter tungsten coiled filament according to the present invention it becomes essential for the filament coil to be centered within said lamp envelope to an accuracy of approximately one precent. Since the present lamp embodiment is again of such high efficiency type, the elevated lamp operating temperatures further requires the lamp envelope to be formed with a relatively refractory light transmissive substance such as fused quartz, aluminosilicate glass or silicate-borate glass. The latter requirement further dicates utilization of paricular end seal means for the present filament coil assembly which closely match the thermal expansion characteristics of the selected lamp envelope material. Thus, depending upon the particular refractory metal wire chosen for a lead-in conductor as well as its wire diameter, such selection can require that the free end of the lead-in conductor be first joined to a thin refractory metal foil element in order to achieve the desired hermetic seal. Suitable manufacture of such modified lamp construction again comprises forming a preliminary filament assembly having the filament coil joined directly to the lead-in conductors and foil elements, inserting the filament assembly into one end of the lamp envelope and hermetically sealing both ends of the foil elements by various already known techniques. This type manufacture can be carried out as generally disclosed in U.S. Pat. No. 4,389,201, also assigned to the present assignee, in so far as employing similar manufacturing equipment as therein disclosed together with the further disclosed gas filling and hermetically sealing steps of the manufacture.

DETAILED DESCRIPTION OF THE PREFERRED EMBODIMENTS

Figure 1:
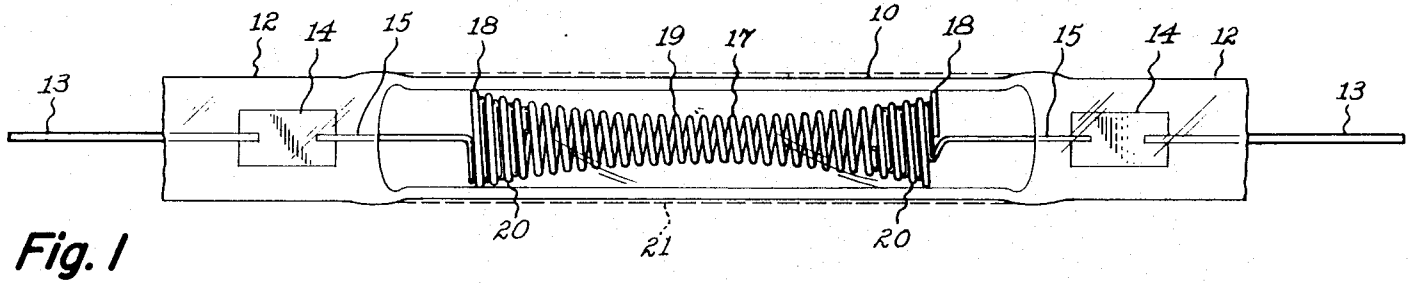
FIG. 1 is a side view depicting one lamp construction embodying the present improved light source, whereas FIG. 1(*a*) is a side view of an alternate embodiment of a lamp employing L-shaped lead-in conductors and FIG. 1(*b*) is a side view of a still further lamp embodiment of the present invention.

Referring to the drawings, a lamp is depicted in FIG. 1 having the same general construction as disclosed in the aforementioned U.S. Pat. No. 4,588,923. Accordingly, said lamp includes a radiation transmissive envelope 10 having an elongated tubular shape and fabricated of a clear fused quartz, or translucent quartz, or quartz-like glass such as that known commercially as VYCOR available from the Corning Glass Works. The illustrated lamp embodiment is a low voltage type which employs a primary coiled filament and can be used as a light source in automotive headlamps and still other low voltage illumination applications. Typical dimensions for a suitable double ended quartz envelope of this type can be 3×5 millimeter diameter quartz tubing having a 10 millimeter length. Each end of said lamp 10 has a pinched portion 12 through which is sealed a lead-in conductor 13 connected to another lead-in conductor 15 by a thin intermediate foil portion 14 which is hermetically sealed and embedded in the pinched portion 12. The foil portion 14 may be a separate piece of molybdenum welded to one end of each of the lead-in conductors 13 and 15. Alternately, the foil portion 14 can be an integral portion of a single length of molybdenum wire. Further, for glass type tubular envelope 10 the lead-in conductors 13 and 15 may be a single rod type member not having foil portion 14, for a straight through entrance into tubular envelope 10. It is still further contemplated for the type lamp herein illustrated that the lead-in conductors be entirely eliminated when the filament coil utilizes a relatively fine sized diameter wire in favor of simply having the outermost terminal ends of the filament coil being hermetically sealed at the ends of the lamp envelope. For such modification to achieve a desired centering of the filament coil within this lamp envelope it would be further necessary to have the outermost terminal ends of both filament coil end turns extend outwardly and be aligned along the central axis of the elongated coil. As a still further lead-in conductor modification which can be adopted in connection with the presently depicted lamp embodiment, a use of the L shaped refractory metal wire lead-in conductors disclosed in the above referenced concurrently filed Ser. No. 243,371 application now U.S. Pat. No. 4,918,356 provides still other advantages. Accordingly, it is contemplated that such lead-in conductors be connected at both ends of the depicted filament coil so that the innermost leg portions are affixed at a predetermined location on the circumference of a single filament coil end turned joined thereto while the free legs of these lead-in conductors can extend outwardly for alignment with the central axis of the elongated filament coil. FIG. 1(*a*) shows the outer portion of each of the lead-in conductors 15 connected to a foil member 14 and the innermost portion of each of the lead-in conductors 15 as being of a bent L-shape and being fixed or joined to a predetermined location on the circumference of a single coil end turn in a manner as more fully disclosed in Ser. No. 243,371. As disclosed in Ser. No. 243,371, the L-shaped conductors may be offset from each other to adjust the amount of the lighted section of the mounted filament.

In accordance with the present invention, an elongated tungsten filament 17 is provided in the depicted lamp embodiment (FIG. 1.) having a primary coil construction and which further utilizes coil turns of varying diameter. The varying coil turns are formed directly upon dynamically coiling a continuous length of the tungsten wire as previously explained and with different segments of the elongated filament coil serving different functions in the lamp construction. More particularly, the largest diameter coil turns 18 serve to position the lighted section of the filament coil along the longitudinal axis of the lamp envelope. Conversely, FIG. 1(*b*) shows an embodiment of a lamp in which the lighted section 19 has a larger diameter than the coil turns 18. The two embodiments of FIGS. 1 and 1(*b*) have been previously mentioned in the "Summary" section in which one embodiment (FIG. 1) is described as having a diameter of the coil end turns which is significantly greater than the diameter of the central coil turns, whereas, the different embodiment (FIG. 1(*b*)) is described as having a diameter of the coil end turns which is significantly less than the diameter of the central coil turns. The centering feature discussed in the "Summary" and to be more fully discussed hereinafter with regard to the diameter of the coil end turns, which is significantly greater than the diameter of the central coil turns, is equally applicable to the diameter of the coil end turns which is significantly less than the diameter of the central coil turns.

As further depicted in the drawing (FIG. 1), these coil end turns physically engage the inner walls of the cylindrical lamp envelope to provide support of the filament coil while further engaging the lead-in conductors. The lighted section 19 of this filament coil is thereby centered within the cylindrical lamp envelope and utilizes smaller diameter coil turns which are physically sized as well as located to meet the desired light output requirements of the lamp. A connecting conical section or segment 20 is required in this filament coil (shown in FIG. 1) for connecting the electrical power supply to the lighted coil section 19 since the coil end turns 18 are effectively shorted by the lead-in conductors affixed thereto. Such connecting segment 20 is shown to have continuously diminishing coil turn diameters which can be further varied with respect to both coil diameter and length of the connecting segment as a further means of centering the lighted section of the filament coil within the lamp envelope. A still further description is provided in FIG. 3 below pertaining to still other considerations applicable to cooperative association between the internal lead-in conductors 15 and the depicted lamp coil 17 for a lamp of this type. A reflective film 21 (FIG. 1) covers the outer surface of the lamp envelope 10 to provide means whereby a major portion of the visible radiation being emitted by said lamp filament 17 is transmitted outwardly from said lamp envelope 10 whereas a major portion of the infrared radiation being emitted by said lamp filament is reflected by said reflective film back towards said filament. As more fully explained in the above mentioned U.S. Pat. No. 4,588,923, said reflective film 21 exhibits the necessary pass-band and stop-band optical characteristics for such operative association with the lamp filament 17 but also makes it essential for maximum benefit that said filament remain accurately centered in the lamp envelope throughout its operating lifetime.

Figure 2:
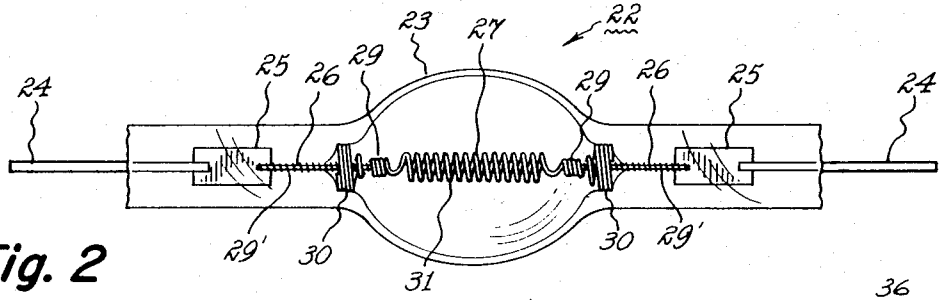
FIG. 2 is a side view for a different lamp construction employing such improved light source means.

In FIG. 2 there is shown a different preferred lamp construction embodying the presently improved light source means. Specifically, said lamp 22 includes a fused quartz envelope 23 having an elliptical or bulbous midportion and is again of the double ended type with both ends of said lamp envelope employing the pinched seal construction herein before described in the preceding embodiment. Each lamp termination thereby features lead-in conductors 24 at each end which are further connected to metal foil elements 25, said foil elements being further connected to internal lead-in conductors 26. A varying coil turn diameter filament coil 27 engages one end of said lead-in conductors 26. Lead-in conductors 26 engage filament coil 27 by threading into the internal cavity of particular filament coil turns 29. It is preferred that at coil turns 29 are single coil turns 29' formed of uncoiled refractory metal wire which are interposed between conductors 26 and coil turns 29 as shown in FIG. 2. The coil turns 29' are separate from or non-continuous with the coil turns 29 and form part of the means for interconnecting conductors 26 to the filament 27, whereas, end turns 30, shown in FIG. 2, are continuous with coil turns 29 and form part of the means for centering filament 27. Such joinder means becomes significant for low voltage lamps wherein the electrical resistance of the lead-in conductors must be maintained relatively low with respect to the electrical resistance of the filament coil. While this objective can be met by increasing the wire diameter size of the wire lead-in conductors, the lamp end or ends required to evacuate the lamp during its manufacture as well as thereafter provide a gas filling to the lamp can become blocked in such manner. Accordingly, it can be seen in the depicted lamp embodiment that sufficient free space is maintained with the present filament assembly to enable the aforementioned manufacturing steps to be readily carried out. In providing such improved lamp filament assembly, the filament coil 27 employs coil end turns 30 sized to center the lighted section 31 of the filament coil in the lamp envelope. Again, such end coil turns are sized to enable physical abutment with the interior wall at the lamp envelope ends. Likewise, the coil turns in the lighted section are sized and pitched to meet light output requirements for the particular end product. While it will be apparent from the above description for the present lamp embodiment that low voltage type lamps are contemplated utilizing a primary coil configuration for the filament coil, that high voltage lamps having the same general lamp configuration can also be provided but which utilize a coiled coil filament assembly to enable the lamp operation at ordinary household voltages. While also not shown in the presently depicted lamp embodiment, it will be further evident that a reflective film can be deposited on the lamp envelope to increase lamp operating efficiency.

Still other criteria have to be met in providing a satisfactory filament assembly for lamps of this general type. Certain criteria applies to the lamp manufacture whereas other criteria applies to the subsequent lamp operation. As regards the lamp manufacture, both low voltage type and high voltage type incandescent lamps have now become increasingly smaller in physical size as indicated by the lamp envelope dimensions previously given for a particular lamp embodiment. Understandably, such dimensional considerations require that the filament assembly be likewise miniaturized which introduces further constraints upon the means employed to join the lead-in conductors to a filament coil along with still further space limitations being created upon physically supporting the assembled lamp components. Such spatial constraints make it now far more difficult or impractical to adhere to conventional practices in both respects. For example, one still widely used conventional practice for joining the lead-in conductor elements to a filament coil utilizes lead-in conductors formed with refractory metal wire lengths having a wire spiral at one end. These components are joined together at both ends of a filament coil by overwinding the filament coil end turns with the spiral turns of the lead-in conductors thereby increasing the diameter of the filament assembly. Carrying out this practice reliably on high speed manufacturing equipment also becomes increasingly difficult as the coil diameter and wire diameter requirements for both these lamp parts continue to decrease. Another conventional practice still in wide use supports the filament coil along the longitudinal lamp axis with refractory metal spacer elements spaced apart along the coil length. Such now employed filament support means do not maintain accurate filament orientation in a number of respects. A common form of the now employed filament support means consists of wire loops again enveloping the filament coil exterior and exerting a spring pressure against the inner wall of the lamp envelope. Understandably, such flexible support means is not only subject to movement during lamp operation along all of the lamp axes but itself requires physical support by the lamp filament if the lamp is burned in a vertical spatial orientation. Moreover, filament support means of this type cannot easily be introduced into an elongated lamp manufacture and with disengagement or misalignment frequently occurring at this time between such spiral support means and the filament coil. It becomes further evident that all of the mentioned problems with supporting a filament coil in this manner becomes increasingly severe as the lamp size decreases.

With respect to still further lamp operating characteristics, it has already been pointed out above that improved energy efficiency requires the filament assembly to be precisely centered within the lamp envelope when a reflective film is being employed. Significant losses of infrared energy can still be experienced at the lamp ends with a properly centered filament assembly, unless there is provided a still further optical cooperation between the centered filament coil and the reflective film at the lamp end locations. More particularly, the physical contour of the filament coil should enable infrared energy at the lamp ends to be reflected back to the filament coil to a greater degree than is now provided in such lamps with the conventional cylindrically shaped elongated coils. For the representative lamp embodiment above depicted in FIG. 2, such improved operating efficency can be achieved according to the present invention with substitution of an elliptical or ball shaped filament coil having the coil end turns significantly smaller in diameter than the diameter of the central coil turns in a manner similar to the lamp of FIG. 1(*b*). The operating characteristics for a filament coil configuration of this type provide still further advantages. Improved "point source" illumination is achieved with such filament coil configuration thereby reducing alignment problems when this lamp provides the light source means in a reflector lamp. A related improvement for such type lamp construction can be expected in automotive headlamps from a reduction in the filament "shadow" now being experienced with conventional filament coils in the projected light beam pattern. That the above noted number and variety of drawbacks now being experienced with conventional light source means for electric incandescent lamps can be reduced or eliminated in accordance with the present invention thereby represents a considerable advance.

Figure 3:
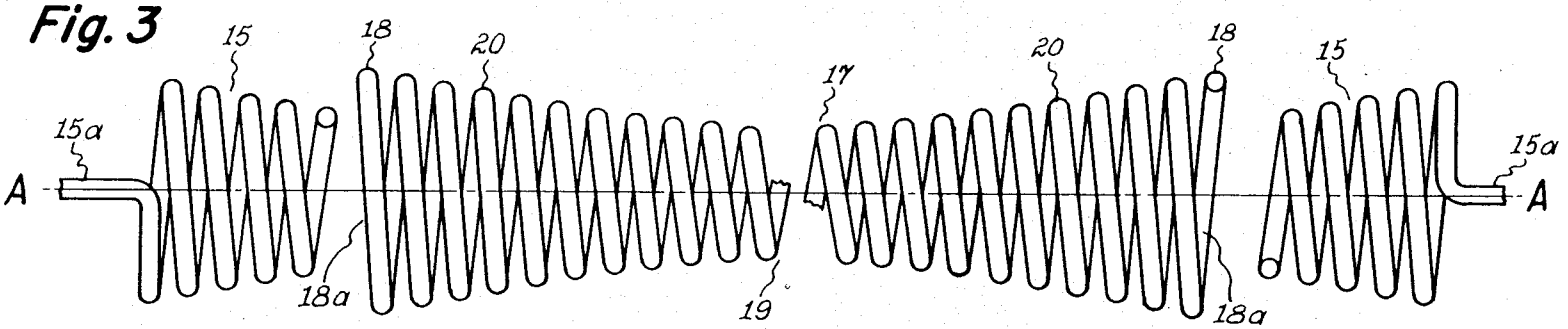
FIG. 3 is an enlarged view depicting the principal features of the coiled filament assembly employed in the FIG. 1 lamp embodiment before the filament coil and lead-in conductors have been joined together.

To still better illustrate the improved cooperative association between the lead-in conductor elements and the elongated filament coil joined thereto in accordance with the present invention, there is provided in FIG. 3 an enlarged side view for the particular filament assembly being employed in the previously described FIG. 1 lamp embodiment. Specifically, the principal components of this filament assembly are depicted before assembly together for subsequent insertion into the lamp envelope (not shown) during the manufacture for such lamp. As depicted in the drawing, the filament assembly employs an elongated primary coil 17 of continuous tungsten wire formed in the uncoiled refractory metal wire by dynamically producing the multiple diameter coil turns devoid of mandrel means. Accordingly, such filament coil turns feature a central cavity opening which is produced directly upon coiling and not requiring that mandrel material be removed therefrom in the customary manner before the filament coil can be utilized in the subsequent lamp manufacture. Of possibly greater significance in the present lamp embodiment is a further ability with such filament coil configuration to form the filament assembly directly after coiling in a distinctive manner. To further explain in such regard, this filament coil 17 can be seen to have a three-part construction with respect to the depicted coil turn diameters. The largest diameter coil turns 18 located at opposite ends of the filament coil enable threading of the lead-in conductor elements 15 into the open central cavity 18*a* of said coil end turns while further precluding such insertion beyond the axial length of these end sections or segments in the filament coil. The lead-in conductor elements 15 being employed in such manner can also be formed by dynamically coiling a continuous length of the uncoiled refractory metal wire to produce coil turns enabling the desired limited insertion thereof into both ends of the filament coil as shown in the drawing. Central section 19 of the depicted filament coil 17 provides the coil turns of least coil diameter and which produce the principal light output in this light source means. A precise self-centering of this lighted section within the lamp envelope is further made possible with the depicted coil configuration. As hereinbefore mentioned, the coil end turns 18 enables aligning the central axis of the elongated coil member 17 along the longitudinal axis A—A of the lamp envelope. Such alignment further results from a cooperative relationship established when the lead-in conductors 15 are joined in the foregoing manner to filament coil 17. The coil end turns 18 in such filament assembly can now be juxtapositioned with respect to the inner walls at the lamp envelope ends so as to be either in close proximity thereto or in actual physical abutment therewith. Correspondingly, the unjoined outermost terminal ends 15*a* of the now connected lead-in conductors 15 will become aligned along the longitudinal axis A—A of the lamp envelope upon being hermetically sealed at the lamp envelope ends. Intermediate diameter coil turns 20 of the depicted filament coil 17 supplies electrical power to the lighted coil section while further providing structural means whereby centering of the lighted section along the longitudinal axis A—A can be achieved together with adjusting the effective length of said lighted section. In this latter regard, lamps can now be constructed with various wattage ratings by adjusting only the lighted length of this filament either alone or in combination with varying the coil turn diameter since such modification will not significantly alter the separate functions provided with the remaining sections of the filament coil. Accordingly, entire families of lamps having the depicted filament assembly are thereby made possible with little other variation being required in the lamp manufacture. A still further adjustment in the lighted length of the filament coil can be provided whereby the intermediate diameter coil turns 20 are stretched apart or opened during the presently contemplated dynamic coiling operation. Such coil formation can both improve the ability to center the lighted coil section within the lamp envelope as well as improve controlling the length of said lighted coil section. It can also be appreciated from the description provided in connection with the herein illustrated filament assembly that providing an electrical connection to the lighted section of the filament coil in this manner has still further benefits. Such relatively close physical proximity of the electrical connection to the lighted coil section together with the relative simplicity as well as relative reliability whereby such electrical connection is made can be expected to reduce the variability now being experienced in the lamp ratings and further minimize coil leg losses.

Figure 4:
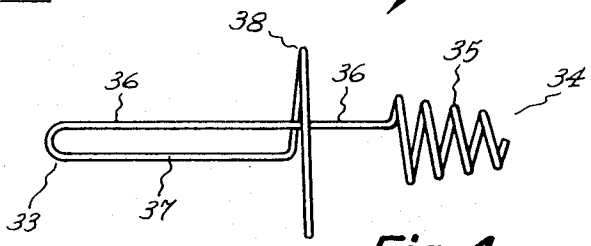
FIG. 4 depicts a particularly useful lead-in conductor element for use in connection with the present invention.
Figure 1A:
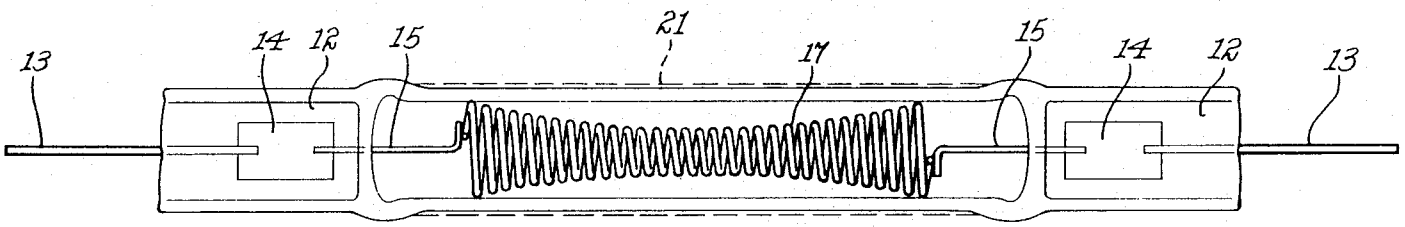
Figure 1B:
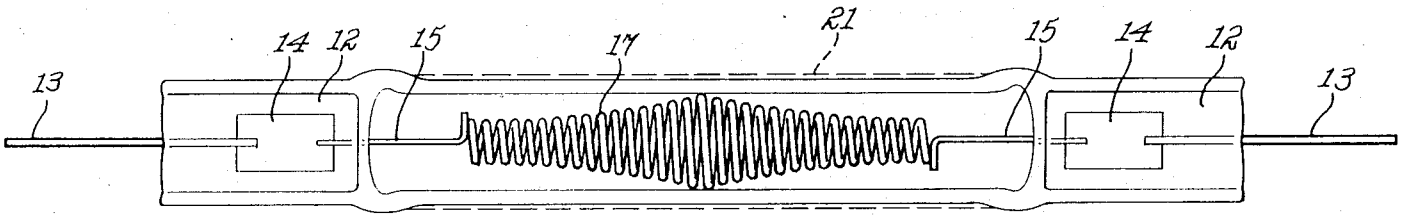

In FIG. 4 there is depicted an enlarged side view for a single refractory metal wire lead-in conductor element 32 having integral coil portions which enable said lead-in construction to be utilized in the FIG. 1 lamp embodiment while further providing physical support the filament assembly. Specifically said lead-in conductor element 32 includes an outermost free end 33 for connecting to one of the refractory metal foil elements 14 depicted in said FIG. 1 embodiment while its innermost opposite end 34 terminates in a spiral 35 having coil turns suitable for threading into the end turns of the filament coil as further explained in connection with the immediately preceding FIG. 3 description for said overall filament assembly. Alternately, a separate spiral can be attached to this end (34) of the lead-in conductor. The herein depicted lead-in conductor element 32 can also be formed by dynamically coiling a continuous length of uncoiled refractory metal wire to provide a bifurcated configuration wherein one leg portion 36 terminates in the spiral coil portion 35 while a second leg portion 37 includes one or more coil turns of larger diameter 38 formed therein to serve as the desired physical support means in the filament assembly. Since this lead-in construction further maintains the overall wire length in leg portion 36 to be significantly shorter in length than open-ended leg portion 37, an electrical connection to said lead-in construction in the assembled lamp embodiment results in the electrical path being desirably limited to the shorter leg portion 36. Accordingly, there is provided thereby an improved lead-in conductor means which can eliminate any further means being needed in the lamp to provide physical support for the filament assembly while not undesirably increasing the electrical resistance for the lead-in conductor elements being utilized to any significant degree.

Figure 5:
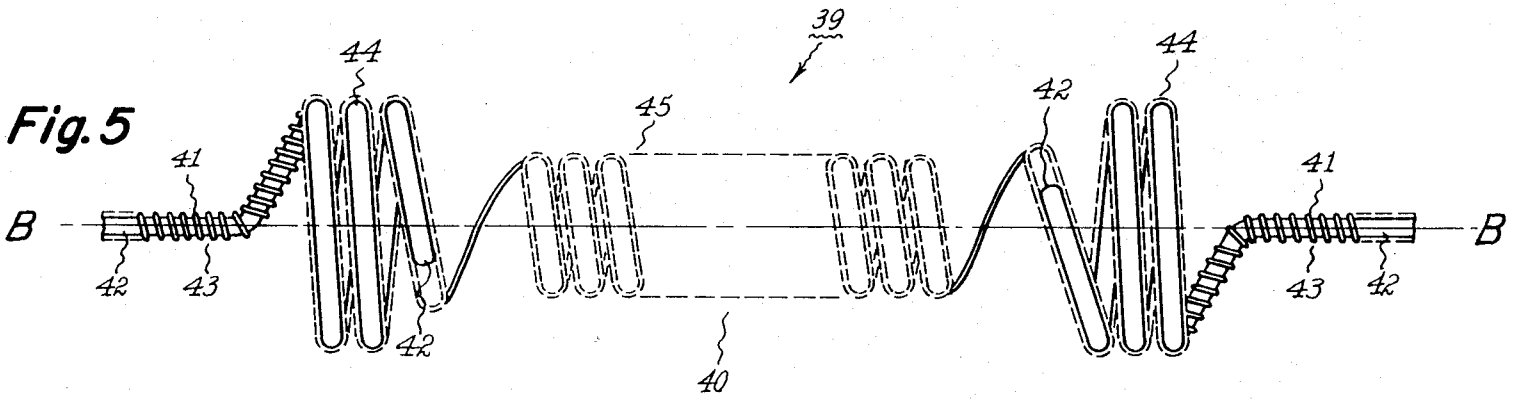
FIG. 5 depicts a still different coiled filament having a coiled coil type construction.

There is depicted in FIG. 5 an enlarged side view for a coiled coil type refractory metal filament assembly 39 also constructed in accordance with the present invention. The elongated filament coil 40 is again formed dynamically to have a three part segment construction with a central axis B—B. Such coiled coil construction is provided wherein a continuous length of the previously coiled wire 41 having a refractory metal mandrel 42 still lodged in the internal central cavity formed by such coil turns is coiled again as previously explained to provide the desired larger size coil turns depicted in the present drawing. The end coil turns 43 provided in such manner at both ends of the filament coil 40 terminate along the central axis B—B to eliminate need for joining any lead-in conductors to the filament coil. Larger diameter intermediate coil turns 44 which also retain the primary mandrel core 42 serve to center the filament coil in the lamp envelope. Coil turns 44 are thereby effectively shorted with such primary mandrel means 42 in order to limit application of the electrical power being supplied to the lamp to the central coil segment 45 of this filament assembly. Such result can be achieved with selective elimination of the primary mandrel core from the central coil segment 45 employing a technique for said purpose which is further described in the above referenced commonly assigned co-pending application Ser. No. 06/944,918. As a consequence of such primary mandrel core removal, the central coil turns become the lighted section of this filament coil with said lighted section being aligned along the central coil axis. The further coaxial alignment of the free ends 43 of the coil turn 44 enables the lighted coil length to be centered in the lamp envelope along the longitudinal axis as above previously explained.

It will be apparent from the foregoing description that a broadly useful light source means for an electric incandescent lamp has been provided enabling a greater efficiency of lamp operation as well as producing a more precise source of illumination from the lamp. It will be further apparent that significant further modifications can be made in the specific contour and physical features of the filament assembly herein disclosed, however, without departing from the spirit and scope of the present invention. For example, still other configurations of the multiple diameter filament coil herein specifically disclosed are contemplated to include multiple lighted sections as are different configurations for the lead-in conductor means being joined together. Likewise, lamp envelopes having a different configuration than herein illustrated can be expected to benefit from a utilization of the same or similar filament assembly. Additionally, the modification of any reflective film being employed to vary the color of visible radiation from such lamp is also contemplated. Consequently, it is intended to limit the present invention only by the scope of the appended claims.

What we claim as new and desire to secure by Letters Patent of the United States is:

1. Ligth source means for an electric incandescent lamp having as the incandescent filament a continuous lenght of refractory metal wire formed directly into an elongated coil having a central axis and with coil turns at both ends of the elongated coil having a different diameter than the diameter of the central coil turns, at least one of said central turns or the end turns having a diameter selected relative to the inner diameter of an incandescent lamp in which said filament is to be used so as to be in close proximity or in actual physical abutment with a portion of the inner walls of said lamp so as to enable said filament to be coaxial with the longitudinal axis of said lamp when so inserted.

2. The light source means of claim 1 wherein the diameter of the coil end turns is significantly greater than the diameter of the central coil turns.

3. The light source means of claim 1 wherein the diameter of the coil end turns is significantly less than the diameter of the central coil turns.

4. The light source means of claim 1 wherein refractory metal wire lead-in conductor elements are connected to the coil end turns.

5. Light source means for an electric incandescent lamp having as the incandescent filament a continuous length of refractory metal wire in the form of an elongated multiple diameter coil having a central axis with coil end turns disposed at opposite ends of the elongated coil having a first coil diameter selected relative to the inner diameter of said incandescent lamp so as to be in close proximity or in actual physical abutment with a portion of inner walls of said lamp so as to enable the central axis of the elongated coil to be coaxial with the longitudinal axis of the lamp and with the coil end turns being further joined to coil turns having a second smaller coil diameter which are also aligned along the longitudinal axis of the lamp to provide the principal light output from the elongated coil.

6. The light source means of claim 5 wherein the coil end turns are directly joined to the smaller coil diameter turns and with said smaller coil diameter turns being physically positioned substantially equidistant from both ends of the elongated coil.

7. The light source means of claim 5 wherein both coil end turns are joined to the smaller coil diameter turns with intermediate coil turns.

8. The light source means of claim 7 wherein the coil diameter of the intermediate coil turns gradually diminishes from the first coil turn diameter to the second coil turn diameter.

9. The light source means of claim 5 wherein the elongated coil employs first coil turns formed of uncoiled refractory metal wire.

10. The light source means of claim 5 wherein the elongated coil employs second coil turns formed by coiling refractory metal wire having first coil turns.

11. The light source means of claim 10 wherein the first coil turns include spaced apart refractory metal rod elements disposed in the central cavity of the coil turns which define unlighted portions of the elongated coil.

12. The light source means of claim 11 wherein the unlighted portions of the elongated coil provide physical support means.

13. The light source means of claim 5 wherein the outermost terminal ends of both coil end turns extend outwardly and are aligned along the central axis of the elongated coil.

14. The light source means of claim 13 wherein the outermost terminal ends further include intermediate coil turns.

15. The light source means of claim 13 wherein the outermost terminal ends serve as lead-in conductors enabling the elongated coil to be directly hermetically sealed in a lamp envelope.

16. The light source means of claim 5 wherein the coil length and pitch is predetermined by the rated lamp wattage.

17. Light source means for an electric incandescent lamp having as the incandescent filament a continuous length of refractory metal wire in the form of an elongated multiple diameter coil having a central axis with coil end turns disposed at opposite ends of the elongated coil having a first coil diameter selected relative to the innner diameter of said incandescent lamp so as to be in close proximity or in actual physical abutment with a portion of inner walls of said lamp so as to enable the central axis of the elongated coil to be coaxial with the longitudinal axis of the lamp and with the coil end turns being further joined to coil turns having a second smaller diameter which are also aligned along the longitudinal axis of the lamp to provide the principal light output from the elongated coil, both coil end turns of the elongated coil being further connected to refractory metal wire lead-in conductors having the outermost terminal ends also aligned with the central axis of the elongated coil.

18. The light source means of claim 17 wherein the lead-in conductors each comprise a refractory metal wire length having a refractory metal coil joined thereto at one end which enables such end to be threaded into the central opening of the coil end turns of the elongated coil.

19. The light source means of claim 18 wherein connection of the lead-in conductors to the elongated coil occurs with physical engagement between individual coil turns of the lead-in conductors and adjoining coil end turns of the elongated coil.

20. The light source means of claim 17 wherein the coil end turns are directly joined to the smaller coil diameter turns and with said smaller coil diameter turns being physically positioned substantially equidistant from both ends of the elongated coil.

21. The light source means of claim 17 wherein both coil end turns are joined to the smaller diameter turns with intermediate coil turns.

22. The light source means of claim 21 wherein the coil diameter of the intermediate coil turns gradually diminishes from the first coil turn diameter to the second coil turn diameter.

23. The light source means of claim 17 wherein the elongated coil employs single coil turns formed of uncoiled refractory metal wire.

24. The light source means of claim 17 wherein the elongated coil employs coil turns formed by coiling already coiled refractory metal wire.

25. The light source means of claim 17 wherein the outermost terminal ends of both coil end turns extend outwardly and are aligned along the central axis of the elongated coil.

26. The light source means of claim 25 wherein the outermost terminal ends include intermediate coil turns.

27. The light source means of claim 17 wherein the coil length and pitch is predetermined by the rated lamp wattage.

28. The light source means of claim 23 wherein the electrical resistance of the lead-in conductors is maintaned relatively low with respect to the the electrical resistance of the elongated coil.

29. The light source means of claim 17 wherein the lead-in conductors each have an L shaped configuration whereby the innermost leg is affixed at a predetermined location on the circumference of a single coil end turn joined thereto.

30. The light source means of claim 29 wherein the free legs of the lead-in conductors further include an integral thin foil portion.

31. The light source means of claim 29 wherein alignment of the respective lead-in conductors is offset with respect to each other.

32. The light source means of claim 29 wherein the lead-in conductors are joined directly to the elongated coil.

33. The light source means of claim 17 wherein the outermost terminal ends of both lead-in conductors are further connected to refractory metal foil elements.

34. The light source means of claim 17 wherein the elongated coil is tungsten.

35. The light source means of claim 17 wherein the lead-in conductors are molybdenum.

36. The light source means of claim 17 wherein both the elongated coil and lead-in conductors are tugnsten.

37. An electric incandescent lamp comprising in combination an elongated hermetically sealed light transmissive lamp envelope containing an inert gas filling and light source means hermetically sealed within the lamp envelope, the light source means having as the incandescent filament a continuous length of refractory metal wire formed directly into an elongated coil having a central axis and with coil turns at both ends of the elongated coil having a different diameter of the central coil turns at least one of said central turns or the end turns having a diameter selected relative to the inner diameter of said incandescent lamp so as to be in close proximity or in actual physical abutment with a portion of inner walls of said lamp so as to enable said filament to be coaxial with the longitudinal axis of said lamp when so inserted.

38. The lamp of claim 37 wherein the diameter of the coil end turns is significantly greater than the diameter of the central coil turns.

39. The lamp of claim 37 wherein the diameter of the coil end turns is significantly less than the diameter of the central coil turns.

40. An electric incandescent lamp comprising, in combination, an elongated hermetically sealed light transmissive lamp envelope containing and inert gas filling and longitudinally extending light source means having a central axis substantially coincident with the longitudinal axis of the lamp envelope which is hermetically sealed through opposite ends of the lamp envelope, the light source means including as the incandescent filament a continuous length of refractory metal wire in the form of an elongated multiple diameter coil having a central axis with coil end turns disposed at opposite ends of the elongated coil having a first coil diameter selected relative to the inner diameter of said incandescent lamp so as to be in close proximity or in actual physical abutment with a portion of inner walls of said lamp so as to enable the central axis of the elongated coil to be coaxial with the longitudinal axis of the lamp envelope and with the coil end turns being further joined to coil turns having a second smaller diameter which are also aligned along the longitudinal axis of the lamp envelope to provide the principal light output from the elongated coil.

41. The lamp of claim 40 wherein the inert gas filling further includes a relatively small quantity of a halogen substance.

42. The lamp of claim 40 which further includes a reflective film being located on the surface of the lamp envelope.

43. The lamp of claim 42 wherein the reflective film employs a pass-band and stop-band characteristic such that a major portion of the desired visible radiation being emitted by the coiled filament is transmitted outwardly from the lamp envelope whereas a major portion of the infrared radiation being emitted by the coiled filament is reflected backwardly toward the filament.

44. The lamp of claim 40 wherein the coil end turns are directly joined to the smaller coil diameter turns and with said smaller coil diameter turns being physically positioned substantially equidistant from both ends of the elongated coil.

45. The lamp of claim 40 wherein both coil end turns are joined to the smaller coil diameter turns with intermediate coil turns.

46. The lamp of claim 45 wherein the coil diameter of the intermediate coil turns gradually diminishes from the first coil turn diameter to the second coil turn diameter.

47. The lamp of claim 40 wherein the elongated coil employs first coil turns formed of an uncoiled refractory metal wire.

48. The lamp of claim 40 wherein the elongated coil employs second coil turns formed by coiling refractory metal wire having first coil turns.

49. The lamp of claim 40 wherein the coil length and pitch is predetermined by the rated lamp wattage.

50. The lamp of claim 40 wherein both coil end turns of the elongated coil are further connected to refractory metal wire lead-in conductors having the outermost ends thereof aligned along the central axis of the elongated coil.

51. The lamp of claim 50 wherein the lead-in conductors each comprise a refractory metal wire length having a refractory metal coil joined thereto at one end which enables such end to be threaded into the central opening of the coil end turns of the elongated coil.

52. The lamp of claim 47 wherein the electrical resistance of the lead-in conductors is maintained relatively low with respect to the electrical resistance of the elongated coil.

53. The lamp of claim 50 wherein the outermost terminal ends of both lead-in coductors are further connected to refractory metal foil elements.

54. In the manufacture of an electric incandescent lamp which comprises an elongated hermetically sealed light transmissive lamp evelope containing an inert gas filling and light source means hermetically sealed within the lamp envelope, the steps of providing a preliminary filament assembly having as the incandescent filament a continuous lenght of refractory metal wire formed directly into an elongated coil having a central axis and with coil turns at both ends of the elongated coil having a different diameter than the diameter of the central coil turns, at least one of said central turns or the end turns having a diameter selected relative to the inner diameter of said incandescent lamp so as to be in close proximity or in actual physical abutment with a portion of inner walls of said lamp so as to enable said filament to be coaxial with the longitudinal axis of said lamp when so inserted, inserting the filament assembly into the lamp envelope with the elongated coil being physically positioned and aligned within said lamp envelope based upon optical considerations, and hermetically sealing the lamp envelope at both ends.

55. The lamp manufacture of claim 54 wherein the diameter of the coil end turns is significantly greater than the diameter of the central coil turns.

56. The lamp manufacture of claim 54 wherein the diameter of the coil end turns is significantly less than the diameter of the central coil turns.

57. In the manufacture of an electric incandescent lamp which comprises an elongated hermetically sealed light transmissive lamp envelope contining an inert gas filling along with an incandescent refractory metal coil filament having a linear axis substantially coincident with the longitudinal axis of the lamp envelope, the steps of providing a preliminary filament assembly having as the incandescent filamente a continuous length of refractory metal wire formed into a multiple diameter coil having a central axis with coil end turns disposed at opposite ends of the elongated coil having a first coil diameter selected realtive to the inner diameter of said incandescent lamp so as to be in close proximity or in actual physical abutment with a portion of the inner walls of said lamp so as to enable the central axis of the elongated coil to be coaxial with the longitudinal axis of the lamp envelope and with the coil end turns being further joined by coil turns having a second smaller coil diameter which are also aligned along the longitudinal axis of the lamp evelope to provide the principal light output from the elongated coil, inserting the coil filament into the lamp envelope so that its central axis is substantially coincident with the longitudinal axis of the lamp evelope, and hermetically sealing the lamp evelope at both ends.

58. The lamp manufacture of claim 57 wherein the coiled filament is connected at opposite ends to refractory metal wire lead-in conductors before insertion into the lamp envelope.

59. The lamp manufacture of claim 58 wherein the outermost end of each lead-in conductor is further joined to a thin refractory metal foil element.

60. The lamp manufacture of claim 58 wherein the lead-in conductors each comprise a refractory metal wire length having a refractory metal coil joined thereto at one end which enables such end to be threaded into the central opening of the coil end turns of the elongated coil.

61. The lamp manufacture of claim 58 wherein the lead-in conductors each have an L shaped configuration whereby the innermost leg is affixed at a predetermined location on the circumference of a single coil end turn joined thereto while the remaining outermost free leg is disposd substantially parallel to the central axis of the elongated coil.

* * * * *